United States Patent [19]

Marhefka

[11] 3,980,335

[45] Sept. 14, 1976

[54] RECLINING CHAIR

[75] Inventor: Matthew D. Marhefka, Southampton, Pa.

[73] Assignee: The Bunting Company, Inc., Philadelphia, Pa.

[22] Filed: Aug. 29, 1975

[21] Appl. No.: 609,119

[52] U.S. Cl. ..... 297/90; 297/68

[51] Int. Cl.[2] ..... A47C 1/034

[58] Field of Search ..... 297/68, 83, 84, 86, 297/90, 91; 5/66

[56] References Cited

UNITED STATES PATENTS

| | | | |
|---|---|---|---|
| 612,384 | 10/1898 | Glascock et al. | 297/90 X |
| 2,949,955 | 8/1960 | Barabas et al. | 297/90 X |
| 3,147,039 | 9/1964 | Smith et al. | 297/90 |

FOREIGN PATENTS OR APPLICATIONS

| | | | |
|---|---|---|---|
| 782,066 | 5/1935 | France | 297/86 |
| 1,015,281 | 9/1952 | France | 297/90 |
| 1,162,248 | 9/1958 | France | 297/68 |

*Primary Examiner*—Roy D. Frazier
*Assistant Examiner*—William E. Lyddane
*Attorney, Agent, or Firm*—Seidel, Gonda & Goldhammer

[57] ABSTRACT

A reclining chair has a frame and a seat fixedly and immovably secured to the frame. A back is pivotally mounted to the rear of the frame and extends downwardly beneath the seat. A leg rest is pivotally mounted to the front of the frame and includes an inwardly curved portion at the top thereof which extends beneath the seat. The lower part of the back is connected to the curved portion of the leg rest through a link member such that movement of either the back or the leg rest imparts movement to the other. The connections between the link member, the back, the leg rest and the frame are such as to provide an over-center safety lock which prevents the chair from being accidentially moved from its upright position into its reclining position. Built-in stop mechanisms in the link connection limit the full upright and full reclining positions of the chair.

11 Claims, 7 Drawing Figures

FIG. 5
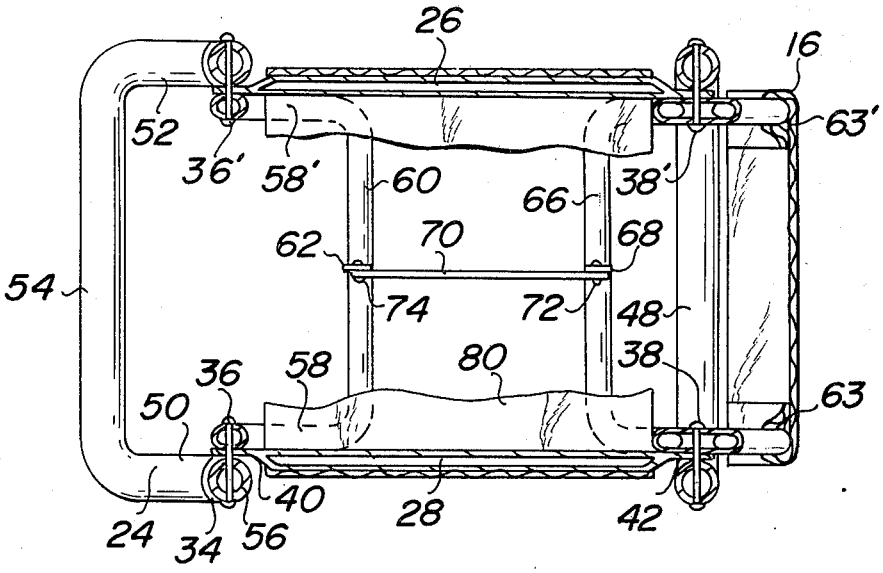
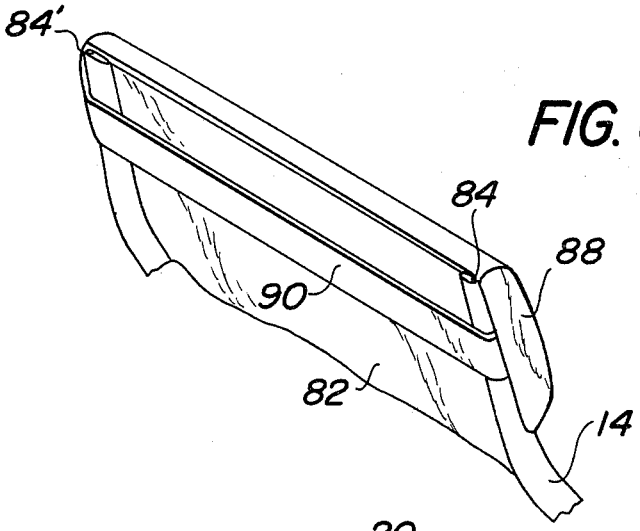
FIG. 6
FIG. 7
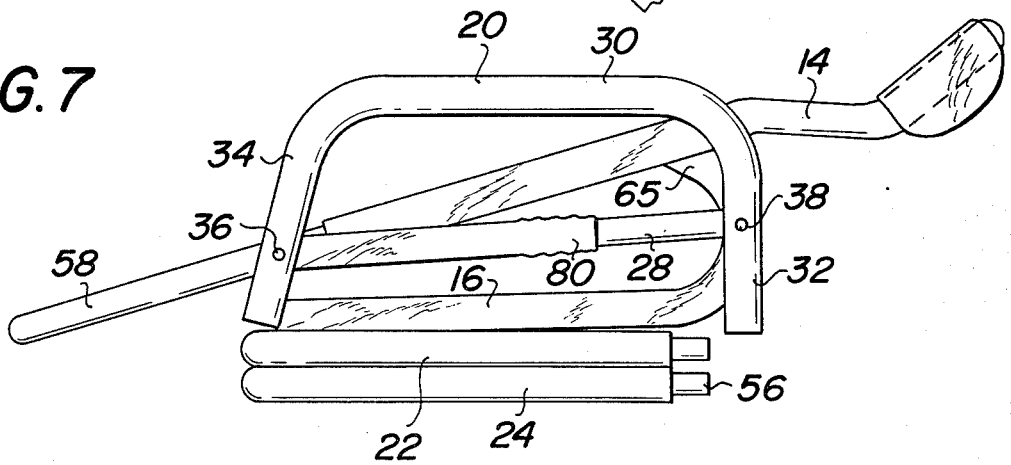

RECLINING CHAIR

This invention relates to a reclining chair and more particularly to a reclining chair which includes an over-center safety feature for preventing the chair from being accidentally moved from its upright position into its reclining position.

Reclining chairs having a fixed seat and a back and leg rest pivotally mounted to the seat and being linked together so as to move in unison have been known in the art for some time. One such chair is shown, for example, in British Pat. No. 17,998, Dec. 10, 1888. This patent shows a reclining chair having a seat and a back and leg rest pivotally mounted to the seat. The back of the chair extends below the seat and is linked at this lower portion to a projection at the top portion of the leg rest. As with similar chairs known in the art, when the back of the chair is moved into its reclining position, the leg rest moves upwardly into its reclining position.

Chairs such as that shown in British Pat. No. 17,998 and other chairs known in the art have not been totally satisfactory for several reasons. It is desirable with reclining chairs to provide them with some type of locking means for preventing the chair from being moved into the reclining position when such movement is not desired. Prior art chairs, however, either have no such locking means or the locking means is a relatively intricate assembly which can easily malfunction. Such locking mechanisms are quite often comprised of a rack member carried by the chair arms which engages a pin fixed to the chair frame. One such arrangement is shown in U.S. Pat. No. 1,114,153. Arrangements such as those shown in this patent also suffer from the disadvantage that means must be provided for moving the arms in conjunction with the back and leg rests. In other words, such arrangements cannot be easily adapted to reclining chairs having fixed arms.

The present invention overcomes all of the above described disadvantages of the prior art and provides a reclining chair having a frame with arms and a seat fixedly and immovably secured to the frame. The chair has a back which is pivotally mounted to the rear of the frame and which extends downwardly beneath the seat. A leg rest is pivotally mounted to the front of the frame and includes an inwardly curved portion at the top thereof which also extends beneath the seat. The lower part of the back is connected to the curved portion of the leg rest through a link member such that movement of either the back or the leg rest imparts movement to the other. The connections between the link member, the back, the leg rest and the frame are such as to provide an over-center safety lock which prevents the chair from being accidentally moved from its upright position to its reclining position. In addition, built-in stop mechanisms in the link connection limit the full upright and full reclining positions of the chair.

It is therefore an object of the present invention to provide a reclining chair which includes a simple yet efficient safety lock feature for preventing the chair from being accidentally moved from its upright position to its reclining position.

It is a further object of the present invention to provide a reclining chair having built-in stop mechanisms for limiting the full upright and full reclining positions of the chair.

It is another object of the present invention to provide a reclining chair which is relatively simple and inexpensive to manufacture.

It is a still further object of the present invention to provide a lightweight reclining chair which can be easily knocked down and then reassembled for ease in shipping or storage.

For the purpose of illustrating the invention, there is shown in the drawings a form which is presently preferred; it being understood, however, that this invention is not limited to the precise arrangements and instrumentalities shown.

FIG. 5 is a cross-sectional view taken along the lines 5—5 of FIG. 3.

FIG. 6 is a perspective view of a headrest which can be used with the reclining chair of the present invention.

FIG. 7 is a side view of a reclining chair of the present invention which is knocked down for shipping or storage.

Figure 1:
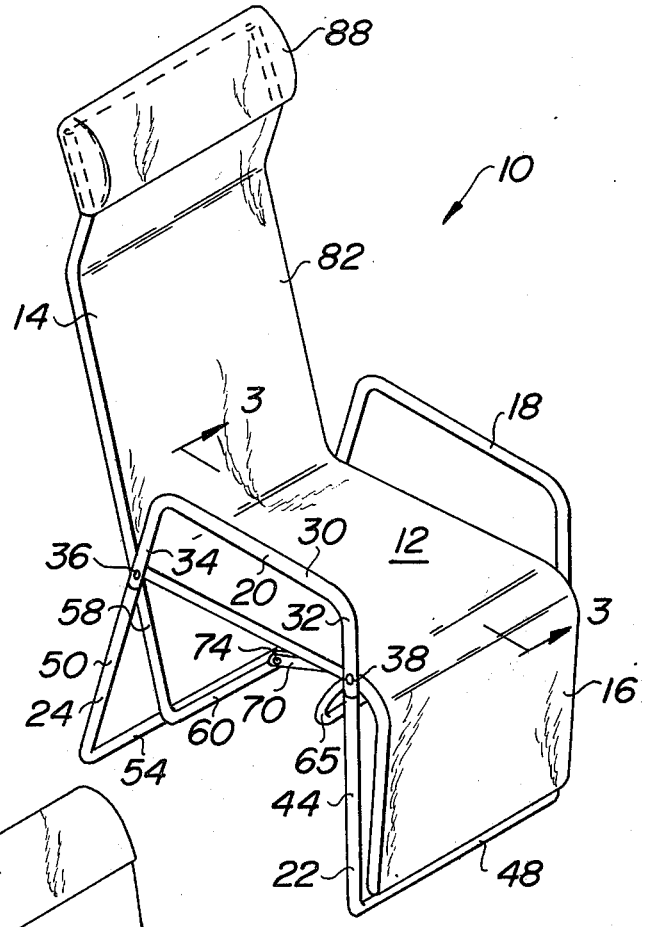
FIG. 1 is a perspective view of a reclining chair constructed in accordance with the principles of the present invention and being shown in its upright position.

Referring now to the figures in detail wherein like numerals designate like elements throughout each of the figures, there is shown in FIG. 1 a reclining chair constructed in accordance with the principles of the present invention and designated generally as 10. The chair is comprised essentially of a seat 12, a back 14 and a leg rest 16. The seat is rigidly and immovably secured to a frame which is comprised of fixed arms 18 and 20, front legs 22, rear legs 24 and left and right seat support bars 26 and 28. Left and right seat support bars 26 and 28 are shown most clearly in FIGS. 3–5. For ease of construction and in order to make the chair lightweight and attractive, the entire reclining chair is made from tubular metal which is covered in part with canvas or similar material.

It should be readily apparent that the reclining chair of the present invention is, for the most part, symmetrical about a plane passing lengthwise through the center of the chair. In other words, the features and construction of the left and right side of the chair are identical, or more correctly, are mirror images of each other. Accordingly, only one side of the chair will be described in detail, it being understood that the side not specifically described is constructed and functions in substantially the same manner. For clarity, primed numbers will be used to designate some of the elements on one side of the chair which have corresponding elements on the other side and which are designated by unprimed numbers.

As shown in FIG. 1, arm 20 includes a substantially horizontal portion 30, a front downwardly directed portion 32 and a rear downwardly directed portion 34. As shown best in FIGS. 5 and 7, seat support bar 28 is secured to the downwardly directed portions 32 and 34 of the arm 20 through pins 36 and 38. It can also be seen in FIG. 5 that each end of the seat support bars is flattened such as shown at 40 and 42.

Referring again to FIG. 1, it can be seen that front legs 22 and back legs 24 are identical to each other.

Front legs 22 include a pair of vertical portions 44 and 46 and a horizontal portion 48 connected between the two vertical portions. Similarly, back legs 24 are comprised of a pair of vertical portions 50 and 52 which are connected by a horizontal portion 54. The free top end of each of the vertical portions includes a projection such as shown at 56 which is adapted to be inserted into the open bottom of the downwardly directed portions 32 and 34 of the arms. This is shown most clearly in FIGS. 3 and 4. The projections 56 of the front legs 22 are inserted into the front downwardly directed portions 32 and 32' of the arms and the projections on the back legs 24 are inserted into the back downwardly directed portions 34 and 34' of the arms 18 and 20. However, as stated above, front and back legs 22 and 24 are identical and accordingly can be interchanged with each other.

Back 14 of the reclining chair 10 is comprised of a substantially U-shaped frame which is pivoted to the rear of the main chair frame through pins 36 and 36'. The U-shaped frame of back 14 includes a pair of upwardly extending tubular side members 58 and 58' joined together at their bottoms by a rear tubular cross bar 60. The lower section of back 14 extends downwardly beneath the seat 12. This lower section is comprised of the lower portions of tubular side members 58 and 58' and the rear cross bar 60 which joins tubular members 58 and 58'. A tab element 62 is rigidly secured to rear cross bar 60 at substantially the center thereof and extends generally upwardly when the chair is in its upright position.

Figure 2:
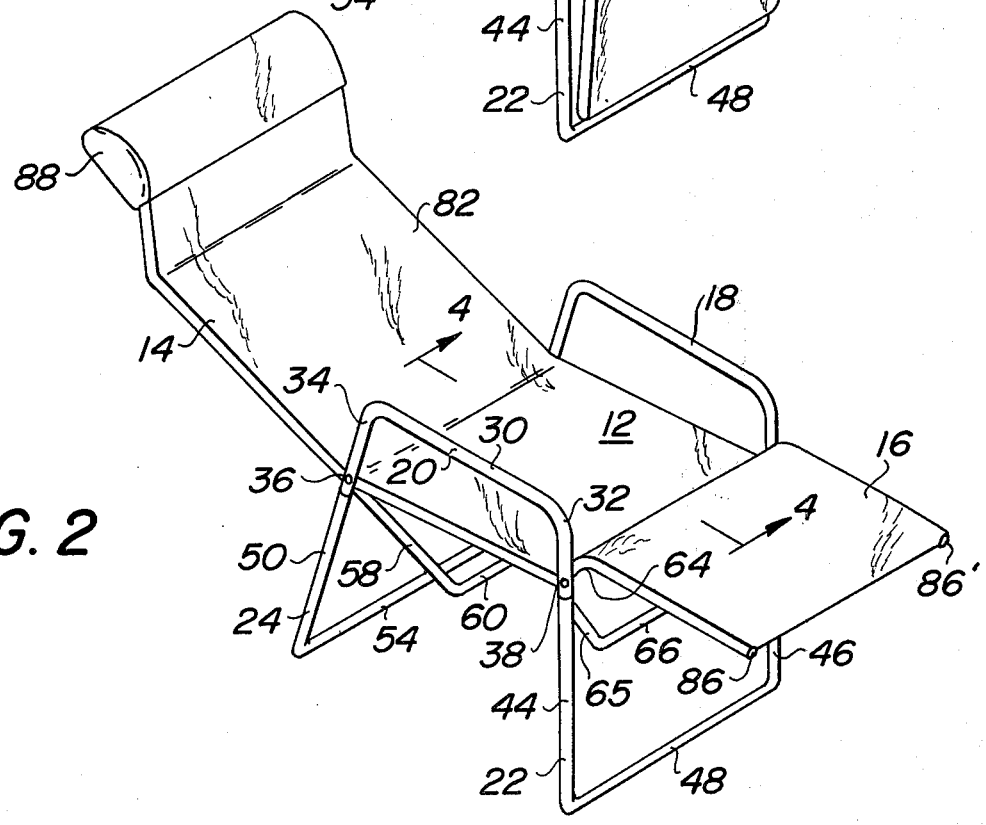
FIG. 2 is a view similar to FIG. 1 showing the chair in its reclining position.
Figure 4:
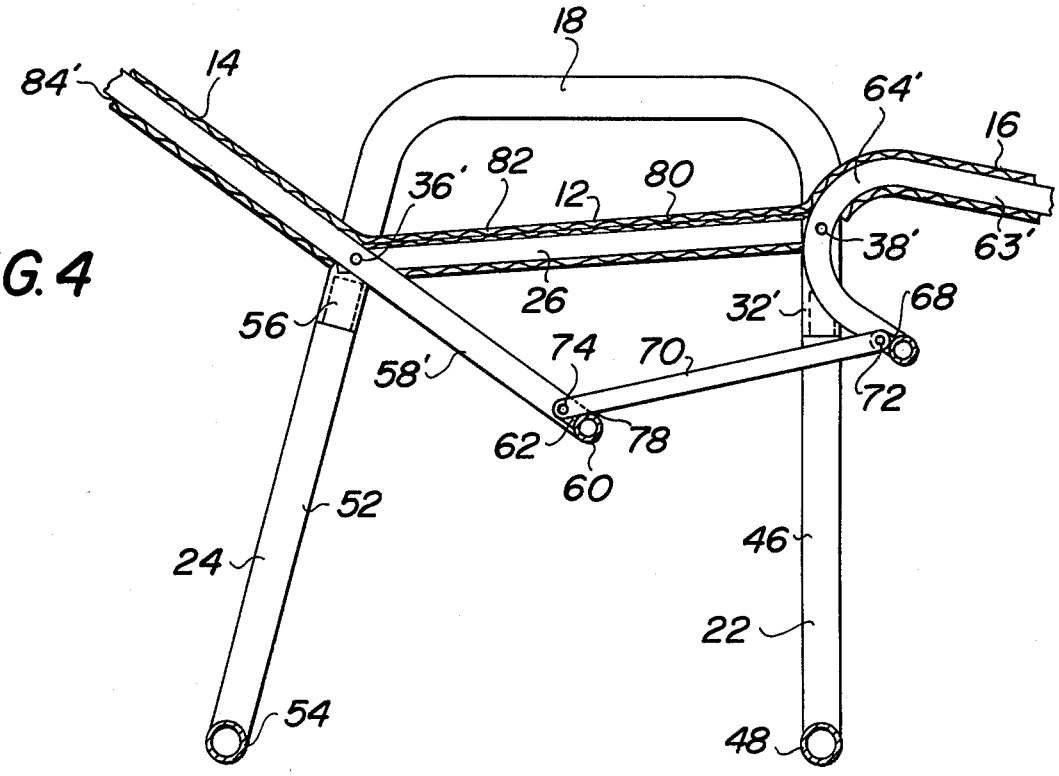
FIG. 4 is a partial cross-sectional view taken along the lines 4—4 of FIG. 2.

Leg rest 16 of chair 10 is similarly constructed of a tubular U-shaped member and includes a reverse bend of inwardly curved portion 64 adjacent the top thereof. The U is actually inverted having its sides 63 and 63' extending substantially downwardly when the chair is in its upright position. At approximately the center of the curved portion 64, leg rest 16 is pivotally mounted to the front of the chair frame through pins 38 and 38'. It can be seen that curved portion 64 of leg rest 16 extends outwardly and downwardly on the forward side of pins 38 and 38'. As a result, when the chair is placed in the reclining position, as shown in FIGS. 2 and 4, the upper part of the leg rest 16 rises slightly above the height of the seat 12 which makes the chair extremely comfortable.

Figure 3:
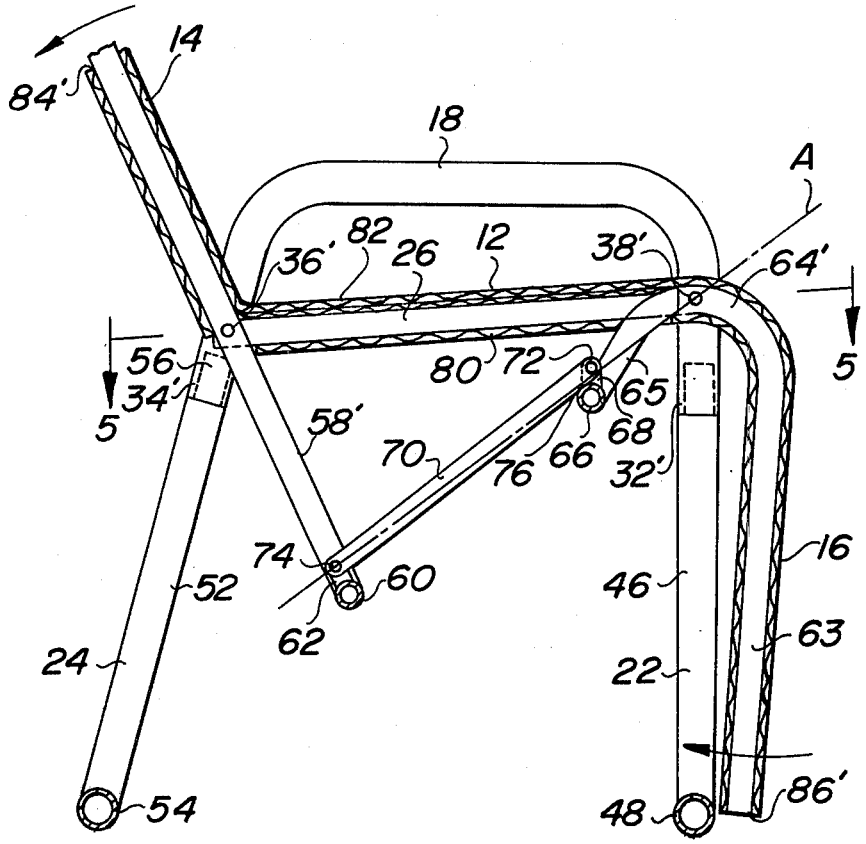
FIG. 3 is a partial cross-sectional view taken along the lines 3—3 of FIG. 1.

When the chair 10 is in its upright position, as shown in FIG. 3, ends 65 and 65' of curved portion 64 extend inwardly and downwardly beneath the seat 12. A substantially horizontal front cross bar 66 extends from one side to the other of the leg rest 16 at the end of the curved portion 64. This cross bar 66 and sides 63 and 63' define the inverted U of leg rest 16. A front tab element 68 is rigidly mounted on the front cross bar 66 at approximately the midpoint thereof. Front tab element 68 extends substantially upwardly when chair 10 is in its upright position. A link member 70 extends between front and rear tab elements 68 and 62, respectively, and is pivotally connected to the tab elements by pins 72 and 74, respectively.

FIG. 3 illustrates the over-center safety lock feature of the invention which prevents the chair 10 from being accidentally moved from its upright to its reclining position. It can be seen in this figure that the pivotal connection between link member 70 and front tab element 68, i.e., pin 72, lies slightly above the imaginary straight line drawn between pin 74 which pivotally connects link member 70 with rear tab element 62 and pin 38 or 38' pivotally connecting leg rest 16 to the chair frame. This imaginary straight line is illustrated by broken line A in FIG. 3. Thus, it should be readily apparent that when the chair 10 is in the upright position shown in FIG. 3, attempted rearward or reclining movement of back 14 in the direction of the arrow as shown, would result in inward movement of the bottom part of leg rest 16. However, in this upright position, the front end of link 70 abuts front cross bar 66 as shown at 76. This interaction of link member 70 and front cross bar 66 acts as a stop means to prevent inward movement of leg rest 16 past its full upright position.

It should be readily apparent from FIG. 3 that rearward movement of back 14 will not cause upward movement of leg rest 16 unless the pivot point at pin 72 is below the level of line A. Accordingly, when it is desired to place the chair 10 into its reclining position, all that is necessary is for the person sitting on the chair 10 to reach over and place his hand on part 65 or 65' of the curved portion 64 of leg rest 16 which extends beneath seat 12 and push this part 65 downwardly an inch or two. When part 65 is pushed downwardly, the pivot point at pin 72 also moves downwardly and when this point falls below the level of line A, the chair is easily moved into its reclining position by merely leaning backwardly on back 14.

FIG. 4 is a partial cross-sectional view showing the chair 10 in its full reclining position. In this position, the rearward end of link member 70 abuts rear cross bar 60 at point 78. This acts as a stop means to prevent further rearward movement of back 14. In other words, the arrangement of link member 70, rear cross bar 60 and rear tab element 62 provides a stop means which defines the full reclining position of the chair 10.

As previously stated, the entire chair 10 is preferably manufactured from tubular metal and covered with canvas or some similar fabric. The fabric is essentially in two parts. A first part 80 is secured to seat support bars 26 and 28 and extends laterally across the chair to provide support for the chair seat 12. A second fabric 82 extends substantially the entire length of the chair 10. Preferably, the top and bottom of fabric 82 are formed to have tubular openings such as shown at 84, 84' and 86, 86' at the sides thereof so that the tubular members 63 and 63' of leg rest 16 forwardly of pins 38 and 38' can be inserted into the openings 86 and 86' and the upper part of side tubular members 58 and 58' of the back 14 can be inserted into the upper tubular openings 84 and 84'. The center part of fabric 82 rests on top of fabric 80 to complete the seat 12.

As shown in FIGS. 1, 2 and 6, the chair 10 is provided with a headrest 88 which is secured to the top of back 14 by a strap 90. The strap 90 is relatively taut so that the headrest 88 can be moved up or down into any desired position and it will be maintained in the position to which it is moved.

FIG. 7 illustrates chair 10 in its knocked down or disassembled condition for shipping or storage. Chair 10 is easily disassembled by removing pin 72. This allows back 14 to be folded downwardly and leg rest 16 to be folded under the chair seat 12. As shown in FIG. 7, the forward part of fabric 80 covering the seat must first be slid backwardly slightly to provide an opening for the inward part 65 and front cross bar 66 of curved portion 64 to pass through. In addition, as previously stated, legs 22 and 24 can be removed from the front and back downwardly directed portions 32 and 34 of arms 18 and 20 to complete the disassembly of chair 10.

The present invention may be embodied in other specific forms without departing from the spirit or essential attributes thereof and, accordingly, reference should be made to the appended claims, rather than to the foregoing specification as indicating the scope of the invention.

I claim:

1. A chair movable between an upright position and a reclining position comprising:

a frame including a generally horizontal seat and legs depending downwardly from said seat;

a back pivotally mounted at a first pivot point to said frame adjacent the rear of said seat, said back including a lower section extending downwardly beneath said seat;

a leg rest pivotally mounted at a second pivot point to said frame adjacent the front of said seat, said leg rest including a reverse bend portion adjacent the top thereof extending inwardly and downwardly beneath said seat;

a link member beneath said seat, said link member having a first end pivotally connected at a third pivot point to said lower section of said back and a second end pivotally connected at a fourth pivot point to said reverse bend portion of said leg rest, said pivot points being such that when said chair is in its full upright position said fourth pivot point lies above the level of an imaginary straight line extending between said second and third pivot points whereby attempted movement of said back toward the reclining position forces said leg rest away from the reclining position.

2. A chair as claimed in claim 1 including a first stop means associated with said first end of said link member for preventing said back and said leg rest from moving past said reclining position, said first stop means defining the extent of reclining movement of said chair.

3. A chair as claimed in claim 2 including a second stop means for preventing said leg rest from moving past its full upright position in a direction away from said reclining position, said second stop means defining the full upright position of said leg rest.

4. A chair as claimed in claim 3 wherein said lower back section includes a substantially horizontal rear cross bar extending between the two sides of said lower back section; said leg rest includes a substantially horizontal front cross bar extending between the two sides of said reverse bend portion and said link member is connected between said rear and front cross bars.

5. A chair as claimed in claim 4 wherein each of said front and rear cross bars includes a tab means rigidly secured thereto, each of said tab means extending generally upwardly when said chair is in its upright position, said link member being connected to each of said tab means.

6. A chair as claimed in claim 5 wherein said first stop means is comprised of said link member and said rear cross bar abutting each other when said chair is in its reclining position.

7. A chair as claimed in claim 6 wherein said second stop means is comprised of said link member and said front cross bar abutting each other when said chair is in its upright position.

8. A chair as claimed in claim 1 wherein said reverse bend portion of said leg rest includes a curved portion which extends forwardly of said chair and downwardly when said chair is in its upright position whereby when said chair is moved into its reclining position, said curved portion is elevated to a height above the height of said seat.

9. A chair as claimed in claim 1 wherein said frame includes a pair of immovable arms.

10. A chair as claimed in claim 1 wherein said legs are comprised of a pair of U-shaped members, each U-shaped member including a pair of upright members releasably secured to the remaining parts of said frame and a substantially horizontal member joining the lowermost parts of said pair of upright members.

11. A chair as claimed in claim 1 further including a headrest and means mounting said headrest to said back so that the vertical position of said headrest can be adjusted.

* * * * *